United States Patent [19]

Watts

[11] 4,180,350

[45] Dec. 25, 1979

[54] METHOD FOR FORMING FOUNDATION PIERS

[75] Inventor: James P. Watts, Scottsdale, Ariz.

[73] Assignee: Early California Industries, Inc., Los Angeles, Calif.

[21] Appl. No.: 891,633

[22] Filed: Mar. 30, 1978

[51] Int. Cl.[2] ..... E02D 5/30

[52] U.S. Cl. ..... 405/233; 405/240; 405/267

[58] Field of Search ..... 61/53.58, 53.5, 53.52, 61/53.56, 53.58, 53.64; 405/267, 269, 240, 238

[56] References Cited

U.S. PATENT DOCUMENTS

| | | | |
|---|---|---|---|
| 1,591,165 | 7/1926 | Hesse | 61/53.58 |
| 1,904,079 | 4/1933 | Fowell | 405/240 |
| 1,909,980 | 5/1933 | Newman | 405/267 |
| 2,729,067 | 1/1956 | Patterson | 61/53.58 |
| 3,100,381 | 8/1963 | Case et al. | 405/267 X |
| 3,197,964 | 8/1965 | Fehlmann et al. | 405/267 |
| 3,326,003 | 6/1967 | Marconi | 405/267 |
| 3,645,101 | 2/1972 | Sherard | 405/267 |
| 3,759,044 | 9/1973 | Caron et al. | 405/267 |
| 3,839,871 | 10/1974 | Dyer et al. | 405/267 |

FOREIGN PATENT DOCUMENTS

| | | | |
|---|---|---|---|
| 773816 | 12/1967 | Canada | 405/239 |

*Primary Examiner*—Dennis L. Taylor
*Attorney, Agent, or Firm*—William H. Drummond

[57] ABSTRACT

In forming foundation piers in the earth, a slurry of earth support material such as bentonite clay is mixed under high shear mixing conditions and introduced into the hole as drilling thereof progresses to provide lateral support for the side walls of the hole. Plastic concrete is then injected into the hole, displacing the slurry upwardly until the hole is filled with concrete to the desired level.

The slurry may be recovered for reuse in drilling and forming another foundation pier.

4 Claims, 6 Drawing Figures

METHOD FOR FORMING FOUNDATION PIERS

Figure 1A:
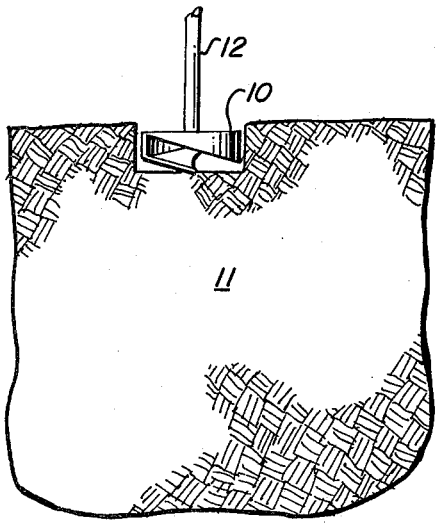

This invention relates to an improved method for forming concrete foundation piers in the earth.

In another respect, the invention relates to a method for forming foundation piers in which special means are provided to prevent the side walls of the drilled hole from collapsing inwardly until the hole is filled with concrete which hardens to form the pier.

In still another aspect, the invention pertains to a method for forming drilled foundation piers in which the slurry displaced from one hole as it is filled with plastic concrete is recovered and reused in the drilling of another foundation pier hole.

According to prior art techniques, foundation piers for structures such as bridges, buildings and the like, are formed by drilling a cylindrical hole in the earth and then filling the hole with plastic concrete which hardens to form the pier which directly supports the load of the structure. The pier functions to increase the effective bearing capacity of the soil because the lower end of the pier rests upon a supporting sub-soil strata having higher bearing capacity than the surface soil. Additional bearing capacity is contributed by the frictional engagement of the pier with the surrounding soil structure and, according to one technique, the bottom of the pier may be flared to provide additional bearing area.

In forming foundation piers according to the above described prior art technique, the difficulties are often encountered due to the tendency of the side walls of the drilled hole to collapse inwardly filling or partially filling the hole with earth or rocks before the drilling is completed and the plastic concrete is poured into the hole.

Various techniques have been proposed to prevent the inward collapse of the side walls of the drilled hole. For example, according to one prior art technique, an earth support material such as bentonite clay is introduced directly into the hole as drilling progresses, along with sufficient water to form a slurry of the bentonite. If the slurry is properly formed, the relatively dense slurry will assist in preventing collapse of the side walls.

However, this prior art technique has not proven generally satisfactory for three reasons. First, in situ formation of the slurry must depend on the efficiency of mixing of the clay and water by the drilling auger, a hit or miss proposition. Secondly, there is no way to adjust the density of the slurry as required to meet varying drilling conditions encountered at various depths in the hole or to take into account the increase in static pressure at the bottom of the hole as drilling progresses. Thirdly, because the slurry is normally incompletely mixed by the auger, there is no efficient way to salvage the slurry for reuse in drilling another hole.

Accordingly, it is an object of the present invention to provide an improved method for forming concrete foundation piers.

Yet another object of the invention is to provide a method for forming foundation piers in which the side walls of the drilled hole are supported by a slurry of earth support material of a preselected and uniform consistency, the density of which can be varied to meet drilling conditions as drilling progresses.

Figure 1B:
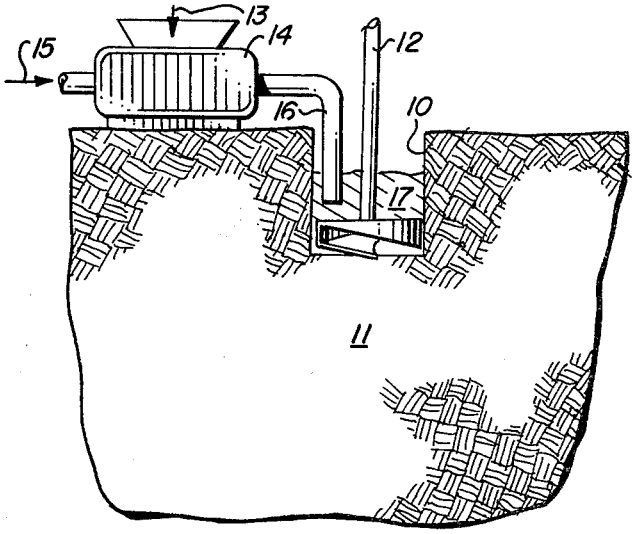
Figure 1C:
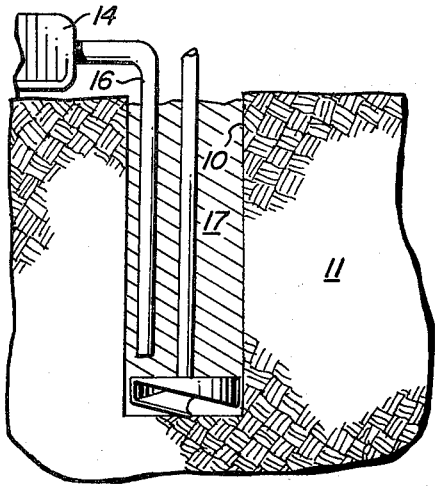
Figure 1D:
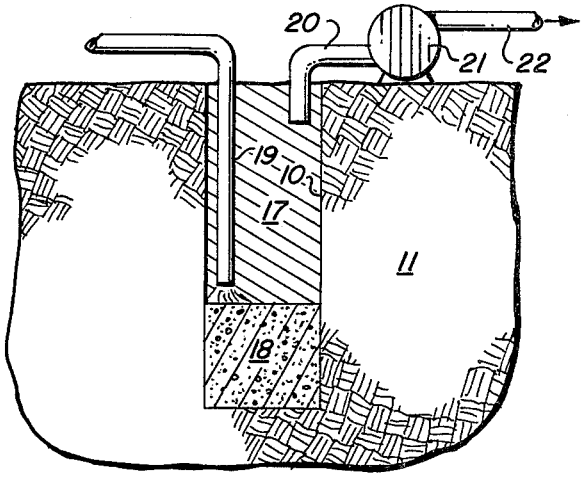
Figure 1E:
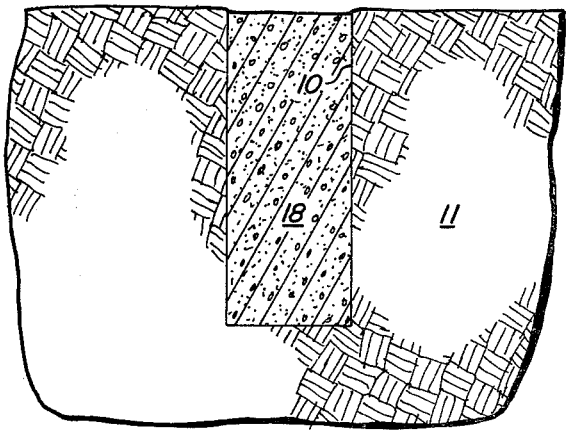
Figure 2:
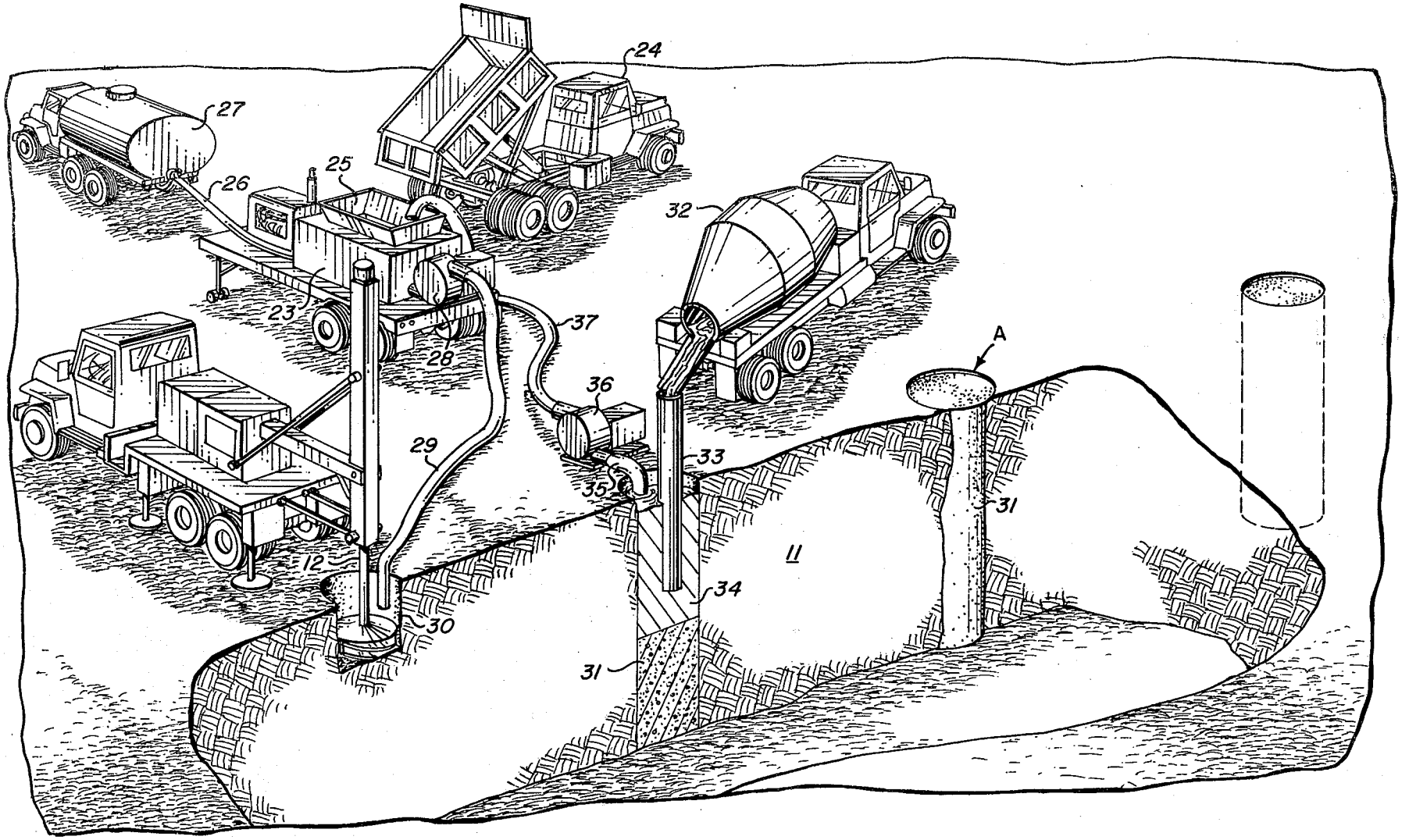

These and other, further and more specific objects and advantages of the invention will be apparent to those skilled in the art from the following detailed description thereof, taken in conjunction with the drawings, in which:

FIGS. 1A–1E are schematic sectional views showing the steps of forming a foundation pier in accordance with the presently preferred embodiment of the invention; and FIG. 2 is a perspective, partially cut away view of a construction site illustrating the steps by which foundation piers are continuously and sequentially formed in accordance with the presently preferred embodiment of the invention.

Briefly, in accordance with my invention, I provide a method for forming foundation piers. The method of the invention is an improvement of the prior art method which includes the steps of drilling a hole in the earth and filling the hole with a plastic concrete mixture which hardens to form the foundation pier. The improvements which are provided in accordance with the invention comprise the steps of mixing a slurry of earth support material under high shear mixing conditions, introducing the slurry into the hole as drilling progresses to provide lateral support for the side walls thereof, and injecting plastic concrete into the hole, thereby displacing the slurry upwardly, until the hole is filled with concrete to the desired level.

The particular earth support material utilized to form the supporting slurry is not highly critical and, in general, one can employ any material, the chemical and physical characteristics of which are suitable for forming a dense slurry, having a density somewhat lower than that of the plastic concrete such that it will be displaced upwardly when the plastic concrete is injected into the hole. For example, and by way of illustration and not limitation upon the scope of the invention, bentonite clay is utilized in accordance with the presently preferred embodiment of the invention. This bentonite clay, when properly mixed with water under high shear conditions, will form uniform, chemically inert slurries of variable density. For example, the density of the slurry can be adjusted as drilling progresses to vary from as much as 4:1 to 36:1 weight ratio of water to clay. Other suitable earth support material includes attapulgite and other clays, gypsum, rhyolites, etc. as well as various chemically modified, accelerated or retarded clays and polymer materials.

In order to achieve optimum slurry consistency, which contributes both to the precision of adjustment of slurry density during drilling and also contributes to the ease and efficiency with which the slurry can be recovered for reuse in drilling another hole, it is important that the mixing of the slurry components be conducted under so-called "high shear conditions". These conditions, while readily achieveable, have never yet been employed to mix earth support slurry for use in drilling foundation piers as herein described, and the method of the present invention is therefore to be clearly distinguished from the prior art practice of separately introducing the slurry forming components into the hole to be mixed by the drilling auger as drilling progresses.

The high shear conditions for mixing the slurry can be readily achieved by any suitable art-recognized technique. For example, in accordance with the presently preferred embodiment of the invention, the bentonite-water slurry is formed by introducing the components in the desired weight ratios into a mixer which is conventionally employed for mixing fire-retardant compositions for aerial application. One such mixer can be obtained commercially from the Chemonics Division of Early California Industries, Inc.

Turning now to the drawings, FIGS. 1A–1E schematically illustrate the steps involved in forming foundation piers according to the improved method of the present invention.

The first step of the method is illustrated in FIG. 1A, which depicts the drilling of a pilot hole 10 in the earth 11 by means of a conventional pier-drilling auger 12.

The second step of the method is illustrated by FIG. 1B, which shows the drilling auger 12 further advanced into the pier hole 10, as drilling progresses. A slurry of earth support material such as bentonite clay 13 is mixed in a mixer 14 with water 15 and is injected through a conduit 16 into the bore hole 10 just above the auger 12. The resultant slurry 17 exerts substantial pressure laterally against the side walls of the bore hole 10 to prevent the earth 11 from collapsing inwardly into the bore hole 10.

At the completion of the drilling, as shown in FIG. 1C, the slurry 17 completely fills the bore hole 10. As drilling progresses, the static head exerted by the slurry 17 contributes to the pressure exerted outwardly by the slurry 17 against the side walls of the hole 10. To conserve clay or other support material, the density of the slurry 17 introduced through the conduit 16 into the bottom of the hole 10 can be progressively reduced. For example, when introduction of the slurry 17 is first commenced, as depicted in FIG. 1B, a slurry density of as high as 4:1 weight ratio (water to bentonite) can be employed to furnish side support for the walls of the bore hole 10, assuming a bulk density of the earth 11 of approximately 90–100 lbs/cu. ft. in repose. As drilling continues, the density of the bentonite slurry 17 introduced into the bottom of the bore hole 10 through the conduit 16 can be progressively reduced, for example, to as low as approximately 36:1 weight ratio (water-bentonite).

Upon completion of drilling of the bore hole 10, as shown in FIG. 1C, plastic concrete 18 is introduced into the bottom of the bore hole 10, as shown in FIG. 1D, through a pipe 19. Concurrently, the earth support slurry 17 is displaced upwardly and is removed from the bore hole 10 by any suitable means such as through the suction line 20 of a slurry removal pump 21. The removed slurry is pumped through the discharge line 22 of the pump 21 and is handled as will be described below.

Upon completion of the procedure as indicated in FIG. 1E, the pier formed by the hardened plastic concrete 18 remains in place completely filling the bore hole 10 in the earth 11.

The method of FIGS. 1A–1E as applied to continuous formation of a plurality of bore holes, according to the presently preferred embodiment of the invention, is depicted in FIG. 2. The earth support slurry is formed in a portable motor-driven mixing apparatus 23 which mixes bentonite clay delivered by truck 24 to the hopper 25 of the mixer 23, water being furnished through a conduit 26 from a tank truck 27. The mixed slurry is pumped by means of a slurry delivery pump 28 through a conduit 29 into the bottom of a starter bore hole 30. Upon completion of the drilling of each bore hole, plastic concrete 31 delivered by a rotary mixer truck 32 is implaced into the hole through a concrete delivery pipe 33 to displace the bentonite slurry 34 upwardly for removal through the suction line 35 of a slurry removal pump 36. The "used" slurry is pumped through a flexible slurry return hose 37 into the hopper 25 of the mixer 23 for recycling. The completed pier formed by the hardened plastic concrete 31 is depicted by reference character A. It will be noted that all of the apparatus utilized in the continuous formation of the foundation piers is portable and the operation proceeds from one side or end of the job site toward the other, the equipment being moved progressively to the left as each pier is completed.

Samples of the slurry being withdrawn from the mixer 23 through the delivery hose 29 can be periodically taken and checked for density by the operator of the mixer such that the water and clay being delivered to the mixer 23 can be proportioned to provide the density desired according to the depth of the bore hole and continuous periodic adjustments can be made as drilling progresses to adjust the density of the slurry, as described above.

Having described my invention in such clear, concise and exact terms as to enable those skilled in the art to understand and practice it and having identified the presently preferred embodiments thereof, I claim:

1. In the method of forming foundation piers including drilling holes in the earth, providing lateral support for the side walls of said holes using a slurry of earth support material above said drill as drilling progresses, and injecting a plastic concrete mixture into said holes to displace said slurry upwardly, thereby filling the holes with said concrete mixture which hardens to form said foundation piers, the improvement comprising the step of:

(a) mixing said slurry under high shear mixing conditions whereby uniformly consistent slurries of preselected variable densities are provided to lend lateral support to the sides of said holes, and (b) varying the density of the slurry injected into said hole as drilling progresses.

2. The method of claim 1 whereby the density of the slurry is progressively reduced as said slurry is introduced into the bottom of said hole during the course of said drilling.

3. The method of claim 2 including the further step of reclaiming said slurry as it is displaced from said hole by the injection of said plastic concrete mixture.

4. The method of claim 2 including the additional step of re-using said reclaimed slurry, suitably mixed as before, to provide lateral support to other holes in which foundation piers are to be formed.

* * * * *